US009693915B2

(12) United States Patent
Turner et al.

(10) Patent No.: US 9,693,915 B2
(45) Date of Patent: Jul. 4, 2017

(54) TRANSFER ASSIST APPARATUS

(75) Inventors: Jonathan D. Turner, Dillsboro, IN (US); Neal Kenneth Jacobs, Carmel, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 330 days.

(21) Appl. No.: 12/433,268

(22) Filed: Apr. 30, 2009

(65) Prior Publication Data

US 2010/0275371 A1 Nov. 4, 2010

(51) Int. Cl.

| | |
|---|---|
| ***A61G 7/008*** | (2006.01) |
| ***A61G 7/10*** | (2006.01) |
| *A61G 7/012* | (2006.01) |
| *A61G 7/005* | (2006.01) |
| *A61G 7/015* | (2006.01) |

(52) U.S. Cl.

CPC ..... *A61G 7/008* (2013.01); *A61G 7/1034* (2013.01); *A61G 7/1044* (2013.01); *A61G 7/005* (2013.01); *A61G 7/012* (2013.01); *A61G 7/015* (2013.01); *A61G 2200/32* (2013.01)

(58) Field of Classification Search

CPC ..... A61G 7/1044; A61G 7/005; A61G 7/008; A61G 7/1034; A61G 7/012; A61G 7/015; A61G 7/018; A61G 2200/32

USPC ..... 5/607, 600, 608; 177/144, DIG. 9

See application file for complete search history.

(56) References Cited

U.S. PATENT DOCUMENTS 322,437 A * 7/1885 Gaston ..... A61G 13/02 269/185
1,266,268 A 5/1918 Hollowell
2,217,783 A * 10/1940 Bell ..... A61G 13/02 5/607
2,311,542 A * 2/1943 Holme ..... A47C 21/006 5/109
3,053,568 A * 9/1962 Miller ..... A61G 5/006 297/344.24
3,806,109 A 4/1974 Weber et al.

(Continued)

FOREIGN PATENT DOCUMENTS

CZ WO 2009100692 * 8/2009 ..... A61G 7/005
DE 3313843 A1 * 10/1984

(Continued)

OTHER PUBLICATIONS

L.&C. Arnold; Pictures of Modell A4 62 EAK Person Support Apparatus; Mar. 1993.

*Primary Examiner* — Robert G Santos
*Assistant Examiner* — David R Hare
(74) *Attorney, Agent, or Firm* — Barnes & Thornburg, LLP

(57) ABSTRACT

A person support apparatus comprises a lower frame, a support, and an upper frame. The support is coupled to the lower frame. The upper frame has a head section and a foot section and defines a longitudinal axis passing through the head section and the foot section and a lateral axis substantially perpendicular to the longitudinal axis. The upper frame includes a tilt mechanism pivotably coupling the upper frame to the support. The tilt mechanism includes a base and a rocker nested within the base. The base and the rocker are pivotable with respect to one another about a pivot axis that passes through the base and the rocker and is substantially parallel the longitudinal axis. The upper frame is pivotable about the pivot axis with respect to the lower frame.

21 Claims, 13 Drawing Sheets

(56) References Cited

U.S. PATENT DOCUMENTS 3,814,414 A * 6/1974 Chapa ..... A61B 6/04 128/873
3,900,906 A 8/1975 Berthelsen
4,006,499 A * 2/1977 Young ..... A61G 7/002 5/608
4,451,945 A 6/1984 Heinz et al.
4,474,364 A 10/1984 Brendgord
4,586,492 A * 5/1986 Manahan ..... A61H 1/003 5/109
4,654,903 A 4/1987 Chubb et al.
4,685,159 A * 8/1987 Oetiker ..... A61G 7/002 5/608
4,927,127 A 5/1990 Lock
5,018,712 A * 5/1991 Schaefer ..... A61B 6/04 5/607
5,023,967 A 6/1991 Ferrand
5,157,787 A * 10/1992 Donnellan ..... A61G 7/002 5/610
5,181,288 A 1/1993 Heaton et al.
5,208,928 A * 5/1993 Kuck ..... A61G 13/02 5/608
5,228,155 A * 7/1993 Shultz ..... A47D 9/02 5/109
5,230,113 A * 7/1993 Foster ..... A61G 5/14 5/604
5,299,334 A 4/1994 Gonzalez
5,410,768 A 5/1995 Manson et al.
5,515,561 A 5/1996 Suggitt et al.
5,640,729 A 6/1997 Marino
6,269,499 B1 8/2001 Amir
6,421,854 B1 * 7/2002 Heimbrock ..... A61G 7/08 280/43.17
6,427,263 B1 * 8/2002 Lindell ..... A61G 5/006 5/607
6,640,363 B1 * 11/2003 Pattee ..... A61G 13/04 5/601
6,651,281 B1 * 11/2003 Figiel ..... A61G 7/0573 5/607
6,817,363 B2 * 11/2004 Biondo ..... A61G 5/006 128/845
6,862,759 B2 3/2005 Hand et al.
6,874,181 B1 4/2005 Connolly et al.
7,000,271 B2 2/2006 Varadharajulu
8,959,680 B2 * 2/2015 Tesar ..... A61G 7/005 5/607
2005/0120480 A1 6/2005 Benedict et al.
2007/0294828 A1 12/2007 Hornbach et al.
2008/0216240 A1 * 9/2008 Valli ..... A61G 7/008 5/608
2009/0031497 A1 * 2/2009 Meissner ..... A61G 13/10 5/607
2009/0049612 A1 * 2/2009 Hornbach ..... A61G 7/008 5/607
2010/0122415 A1 * 5/2010 Turner et al. ..... 5/618
2010/0192300 A1 * 8/2010 Tannoury et al. ..... 5/607
2011/0010858 A1 * 1/2011 Tesar ..... A61G 7/005 5/608

FOREIGN PATENT DOCUMENTS

EP 0474694 B1 10/1994
EP 0705091 B1 5/1997
EP 0743054 B1 7/2002
EP 1419756 B1 9/2007
PL WO 2007145544 * 12/2007 ..... A61G 7/018
WO 9811858 A1 3/1998
WO WO0205740 A2 1/2002
WO 2006123333 A2 11/2006
WO 2007084739 A2 7/2007
WO 2007145544 A1 12/2007

* cited by examiner

TRANSFER ASSIST APPARATUS

BACKGROUND

This disclosure relates to transfer assist apparatuses, and more particularly, but not exclusively, to transfer assist apparatuses that can be adapted to pivot an upper frame of a person support apparatus laterally (side to side) in order to reduce the amount of force required to transfer a person supported on the patient support apparatus to another support apparatus.

It is often necessary for caregivers to transfer people/patients from one support apparatus to another, and/or assist with patient egress from the support apparatus. In order to transfer the person, caregivers can be required to physically pull or lift a portion of the person or a material under the person. Often times only a single caregiver transfers the person, which requires the caregiver to exert the total amount of force needed to transfer the person and can increase the risk of injury to the caregiver and person. Over time the strain of transferring people in this manner can lead to caregivers suffering back injuries. While various transfer assist apparatuses have been developed, in certain applications there is still room for improvement. Thus, a need persists for further contributions in this area of technology.

SUMMARY OF THE DISCLOSURE

One embodiment can include a tilt mechanism rotatably coupling an upper frame to a support that can be adapted to pivot the upper frame laterally (side to side) with respect to the support about a rotational axis and maintain an orientation of the upper frame with respect to the support. In other embodiments, a synchronization system can be coupled with a plurality of tilt mechanisms to synchronize rotation of the tilt mechanisms.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

DESCRIPTION OF SPECIFIC EMBODIMENTS

Figure 1:
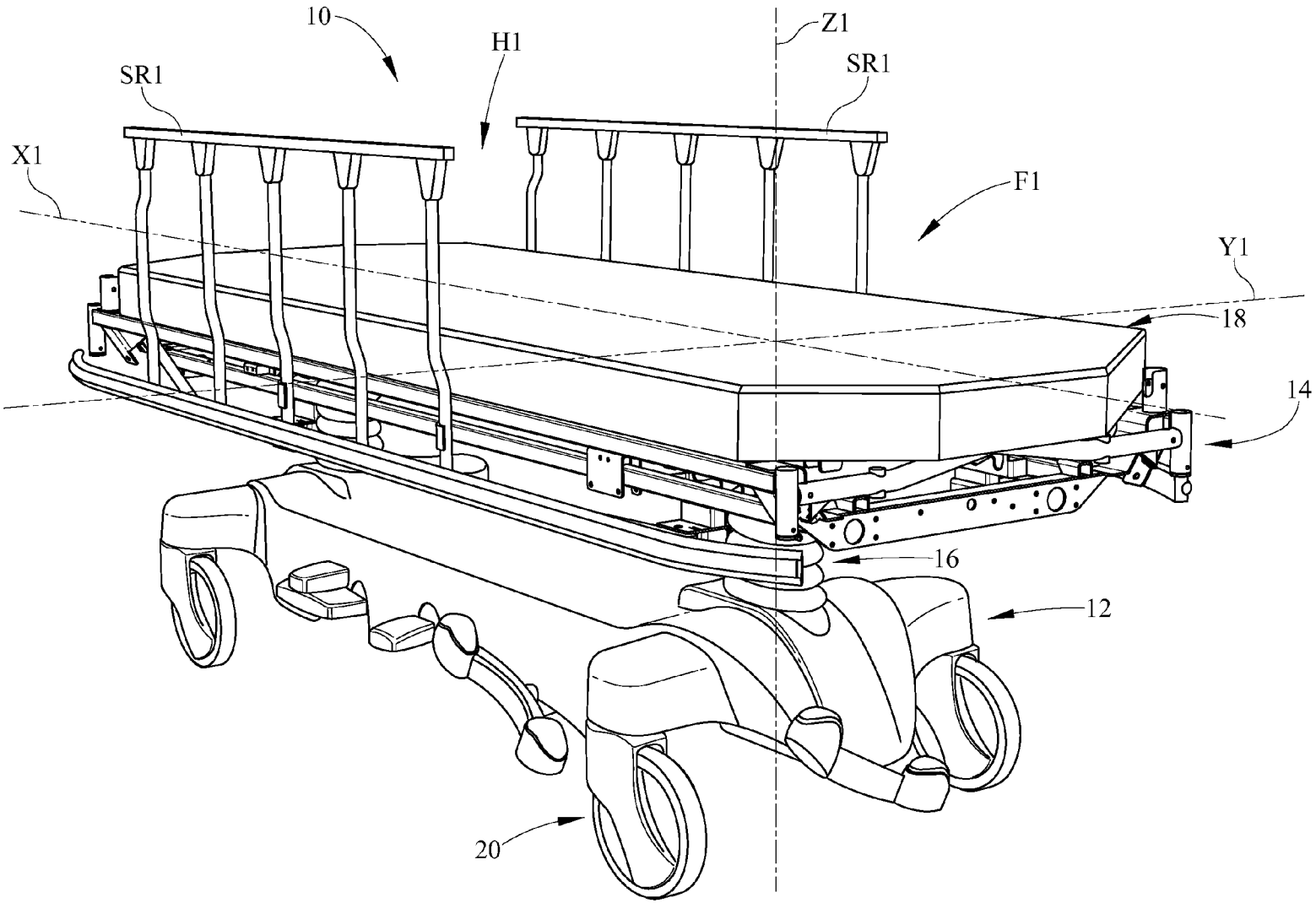
FIG. 1 is a perspective side view of a person support apparatus according to one illustrative embodiment of the current disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One embodiment can include a tilt mechanism rotatably coupling an upper frame to a support that can be adapted to pivot the upper frame laterally (side to side) with respect to the support about a rotational axis and maintain an orientation of the upper frame with respect to the support. In other embodiments, a synchronization system can be coupled with a plurality of tilt mechanisms to synchronize rotation of the tilt mechanisms.

A person support apparatus 10 according to one illustrative embodiment of the current disclosure is shown in FIG. 1. The person support apparatus 10 can be a stretcher that can include a head section H1, where the head of a person (not shown) is positioned, and a foot section F1, where the feet of a person (not shown) are positioned. It should be appreciated that the person support apparatus 10 can be a bed 10 or other support apparatus configured to support a person thereon. The person support apparatus 10 can include a lower frame 12 or base 12, an upper frame 14, and a plurality of supports 16 coupled with the upper frame 14 and the lower frame 12. It should be appreciated that the person support apparatus 10 can include only one support 16.

The person support apparatus 10 can support a person support surface 18 on the upper frame 14 as shown in FIG. 1. The person support surface 18 can be configured to support a person (not shown) in multiple articulated positions. The person support surface 18 can be formed of a single section. It should be appreciated that the person support surface 18 can be formed of multiple sections that can be pivoted relative the upper frame 14 to raise and lower the head and/or feet of the person supported thereon.

The lower frame 12 can couple with the supports 16 to support the supports 16 and the upper frame 14 as shown in FIG. 1. The lower frame 12 can include a single lower frame section supported by casters 20. It should be appreciated that the lower frame 12 can include multiple lower frame sections. It should also be appreciated that the lower frame 12 can be supported by non-rotating feet (not shown) instead of or in addition to casters 20.

The supports 16 can movably support the upper frame 14 above the lower frame 12 as shown in FIG. 1. The supports 16 can define a vertical axis Z1 that can extend through the lower frame 12 and the upper frame 14 and can be substantially perpendicular the lower frame 12 and the upper frame 14 when the lower frame 12 is substantially parallel to the upper frame 14. The supports 16 can be lift mechanisms 16 with a lift driver (not shown) that can cause the lift mechanisms 16 to expand and/or contract to raise and/or lower the upper frame 14 with respect to the lower frame 12. It should be appreciated that the supports 16 can be telescoping towers or canisters, scissor lifts, rotational lifts, hydraulic lifts or actuators, pneumatic lifts or actuators, linear actuators, electronic actuators, chain lifts, or other lift mechanisms. It should also be appreciated that the supports 16 can not be lift mechanisms 16 and can instead be at least one fixed column. The supports 16 can include at least one of a linear actuator, a hydraulic actuator, an electric actuator, a rotary actuator, a chain actuator, a pneumatic actuator, or other actuator.

The upper frame 14 can define a longitudinal axis X1 that extends at least the length of the person support apparatus 10 through the head end H1 and the foot end F1 along the lateral center of the upper frame 14, and a lateral axis Y1 or transverse axis Y1 that can be perpendicular the longitudinal axis X1 and extend at least the width of the person support apparatus 10 through the longitudinal center of the upper frame 14 as illustrated in FIG. 1. The upper frame 14 can be raised and/or lowered relative to the lower frame 12 by the supports. The angular orientation of the upper frame 14 can change relative to the lower frame 12 between a Trendelenberg position where the head end H1 of the upper frame 14 is below the foot end F1 of the upper frame 14 and a reverse Trendelenberg position where the head end H1 of the upper frame 14 is above the foot end F1 of the upper frame 14.

Figure 3:
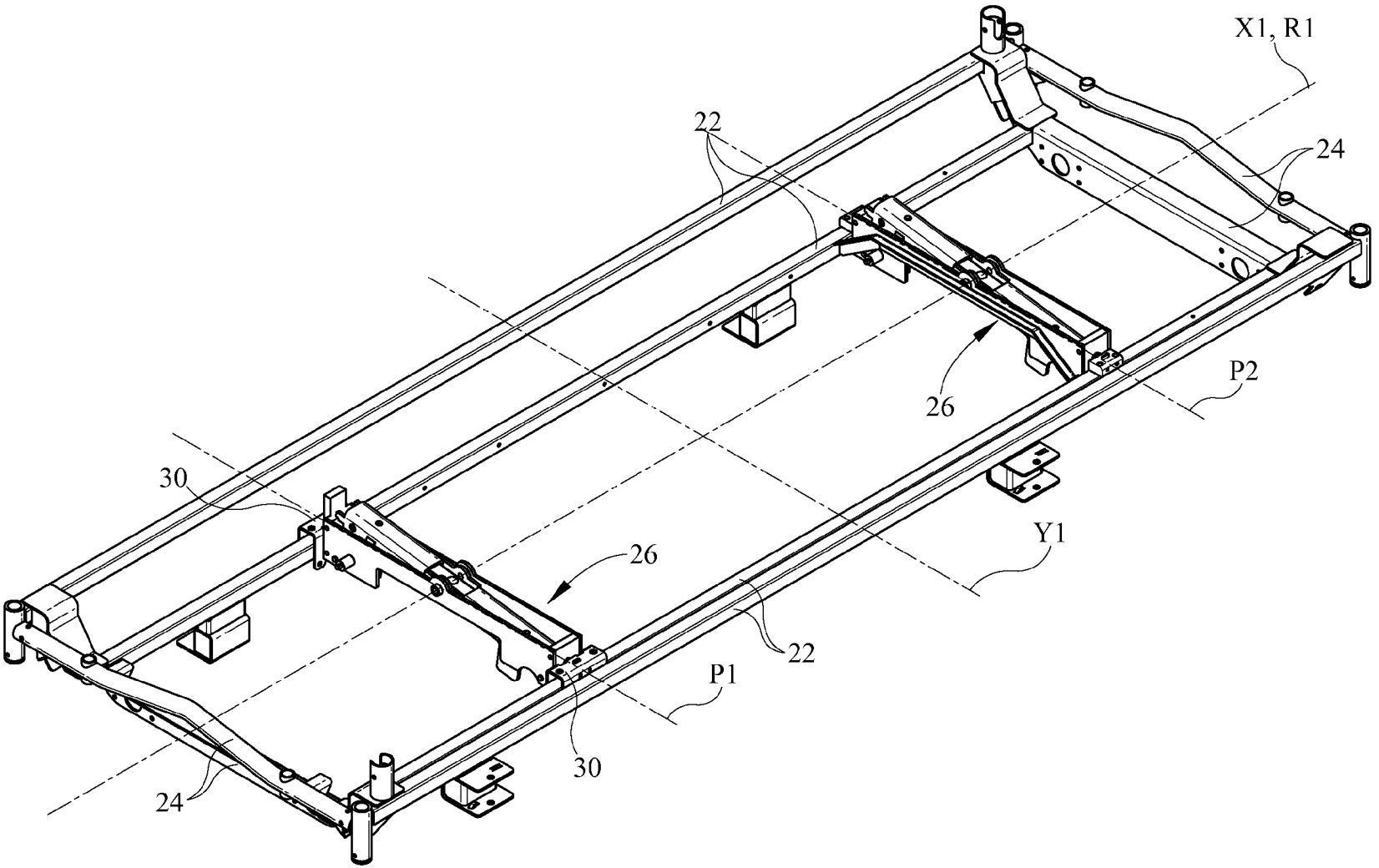
FIG. 3 is a perspective view of the upper frame of the person support apparatus of FIG. 1 including the tilt mechanisms and without the synchronization system.
Figure 5:
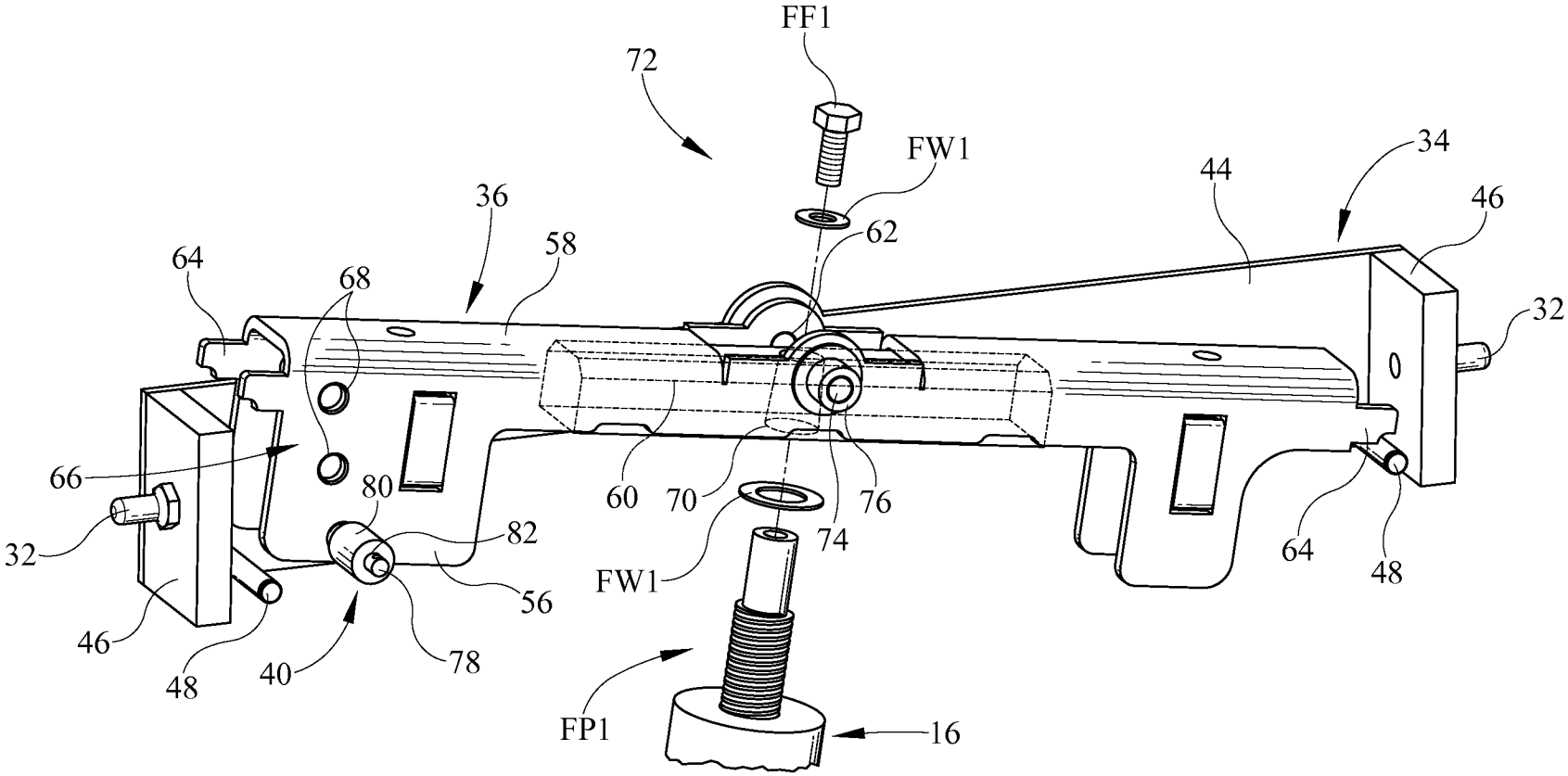
FIG. 5 is perspective side view of the tilt mechanisms of FIG. 2 illustrating the tilt rocker.

The upper frame 14 can include longitudinal frame members 22, lateral frame members 24, tilt mechanisms 26, and a synchronization system 28 for synchronizing actuation of the tilt mechanisms 26 as shown in FIG. 5. It should be appreciated that the upper frame 14 can also include a footboard (not shown), a head board (not shown), and/or side rails SR1 that can be supported by the upper frame 14. It should also be appreciated that the upper frame 14 can include a deck (not shown) supported by an intermediate frame (not shown), where the deck can include multiple sections that can articulate about various axes. It should further be appreciated that the synchronization system 28 can not be included, and instead, the tilt mechanisms 26 can be actuated independently or simultaneously by one or more operators as illustrated in FIG. 3. The longitudinal frame members 22 and lateral frame members 24 can be coupled together to form a generally rectangular shape. It should be appreciated that the upper frame 14 can include additional frame members, such as, cross members (not shown), that can be coupled with the longitudinal frame members 22 and the lateral frame members 24 to provide additional support.

Figure 2:
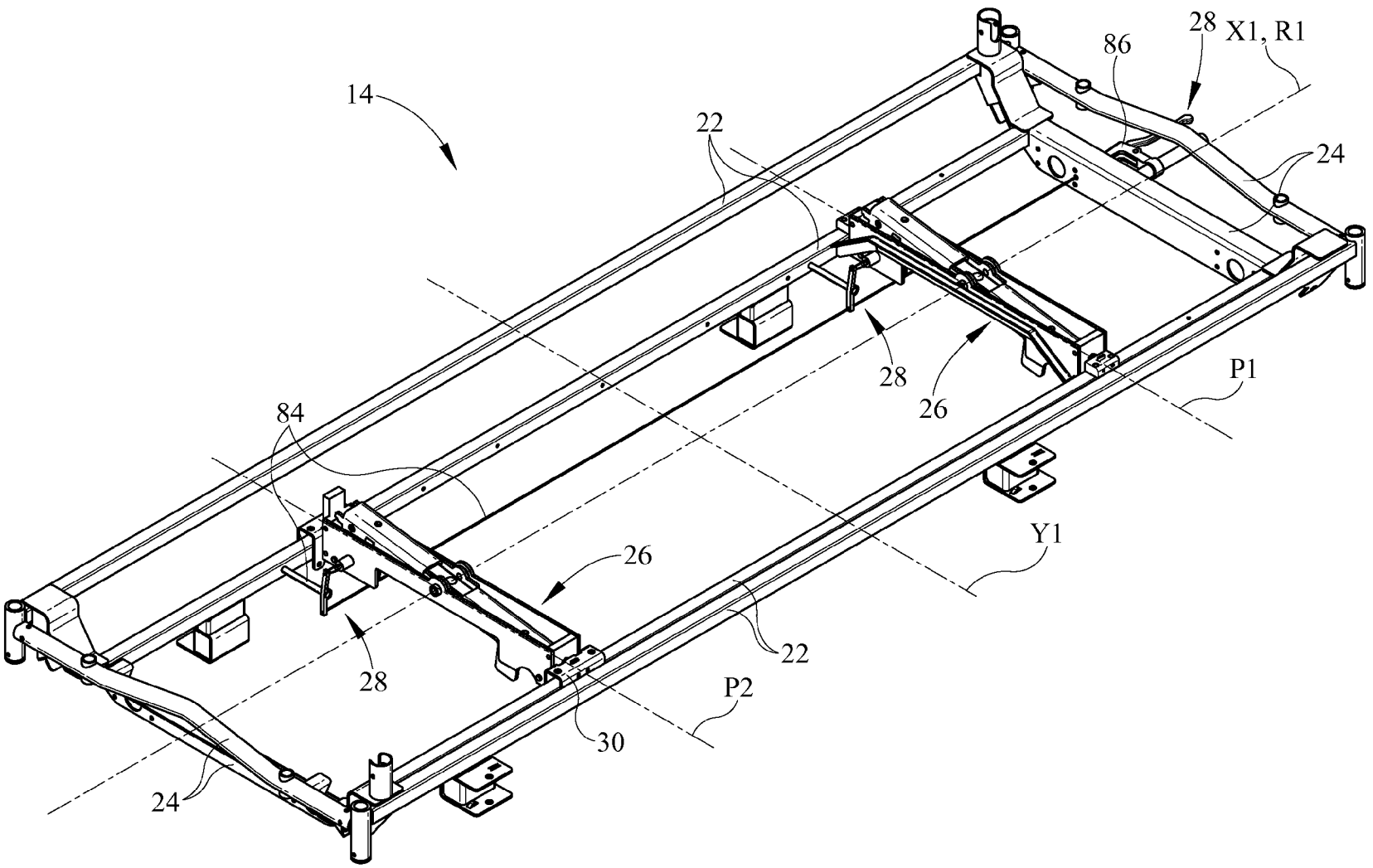
FIG. 2 is a perspective side view of the upper frame of the person support apparatus of FIG. 1 including tilt mechanisms and a synchronization system according to one illustrative embodiment of the current disclosure.

The tilt mechanisms 26 can be coupled to the supports 16 and can pivotably couple the upper frame 14 to the supports 16 as shown in FIGS. 2 and 3. It should be appreciated that the tilt mechanisms 26 can be pivotably coupled to the supports 16. The tilt mechanisms 26 can be pivotably coupled to the upper frame 14 and at least one of the tilt mechanisms 26 can be pivotably coupled to a trolley 30 that can move with respect to the upper frame 14. It should be appreciated that the trolley 30 can engage a track (not shown) on the upper frame 14. It should also be appreciated that the trolleys 30 can be tubes that surround a portion of the longitudinal frame members 22 and slide along the longitudinal frame members 22 or include wheels (not shown) that engage the longitudinal frame members 22. In one illustrative embodiment, one of the tilt mechanisms 26 can be pivotably coupled to the upper frame 14 via a pin 32 defining a first pivot axis P1, and another of the tilt mechanisms 26 can be pivotably coupled to the trolley 30 via a pin 32 defining a second pivot axis P2. It should be appreciated that all of the tilt mechanisms 26 can be pivotably coupled to trolleys 30. The first pivot axis P1 and the second pivot axis P2 can be substantially parallel one another, and the lateral axis Y1. The tilt mechanism 26 can be located at each of the head end H1 and the foot end F1 of the upper frame 14. In one illustrative embodiment, the tilt mechanism 26 can also include a force sensor (not shown), such as, for example, a load cell, coupled thereto to sense changes in force on the upper frame 14.

In one illustrative embodiment, the tilt mechanism 26 can also include a force sensor SS, such as, for example, a load cell, coupled thereto to sense changes in force on the upper frame 14. It should be appreciated that the force sensor SS can be incorporated into the pins 32.

Figure 4:
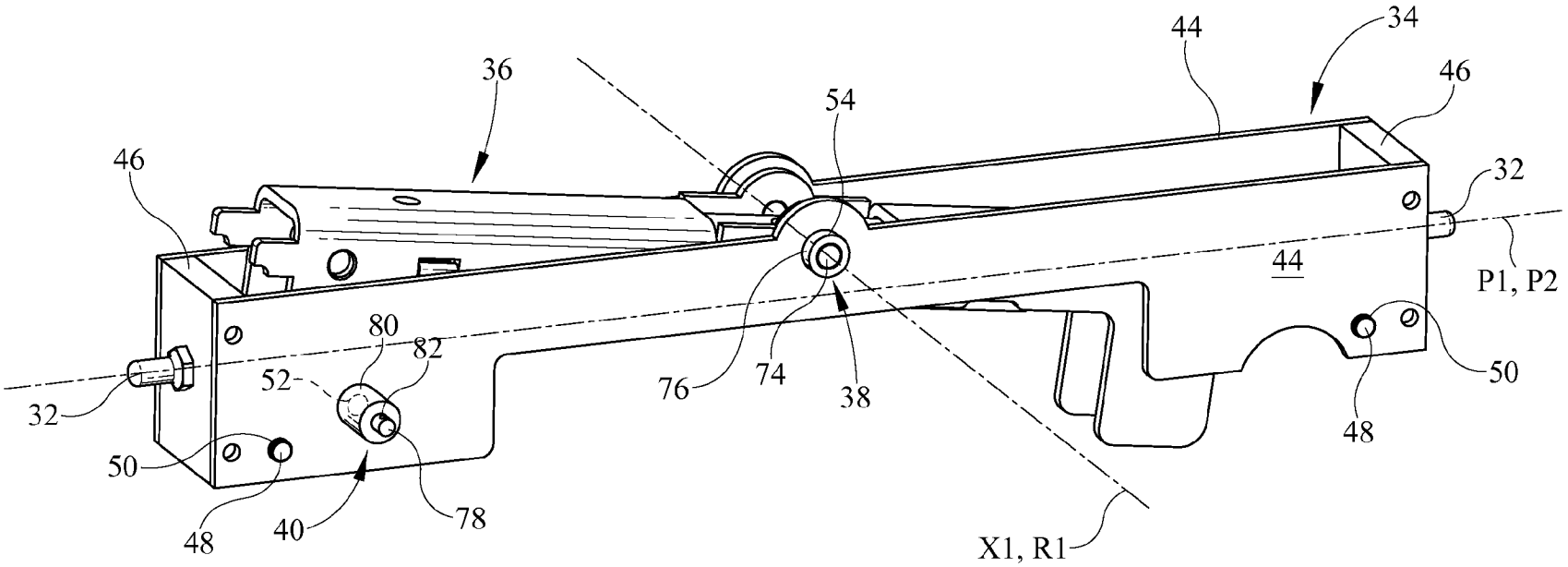
FIG. 4 is a perspective side view of the tilt mechanisms of FIG. 2.
Figure 14:
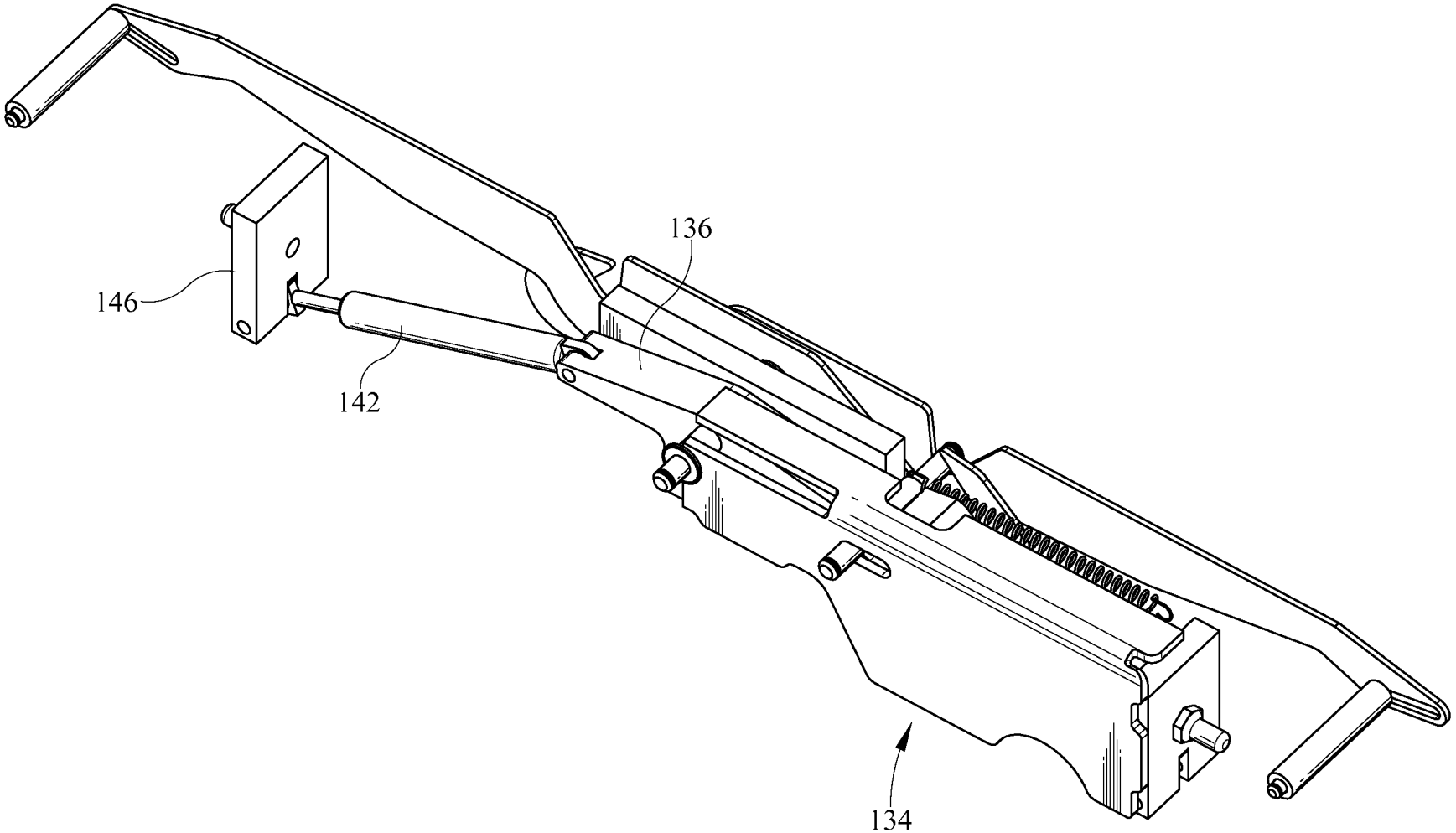
FIG. 14 is a side perspective view of the tilt mechanism of FIG. 6 including a dampener.

The tilt mechanisms 26 can include a tilt base 34, a tilt rocker 36, a rocker pin 38, and a locking mechanism 40 as illustrated in FIGS. 4 and 5. The tilt rocker 36 and the tilt base 34 can be coupled together by way of the rocker pin 38. The rocker pin 38 can define a rocker pivot axis R1 parallel to the longitudinal axis X1 about which the tilt base 34 can pivot with respect to the tilt rocker 36. The tilt base 34 can pivot with respect to the tilt rocker 36 when the locking mechanism 40 is in an unlocked position, and the tilt base 34 can be substantially stationary with respect to the tilt rocker 36 when the locking mechanism 40 is in a locked position. In one illustrative embodiment, the tilt mechanism 26 can include a dampener 142, described below, that can be coupled with the tilt rocker 36 and the tilt base 34 to resist rotation of the tilt base 34 with respect to the tilt rocker 36, for example, as shown in FIG. 14. It should be appreciated that the dampener 142 can be configured to operate as the locking mechanism 40, for example, the dampener 142 can be a gas locking dampener 142.

The tilt base 34 can include base sides 44, base ends 46, and stoppers 48 as illustrated in FIGS. 4 and 5. The base sides 44 can couple with the base ends 46 to form a generally rectangular shape. The base sides 44 can include stopper bores 50, a locking mechanism bore 52, and a rocker pin bore 54. The stopper bores 50 and the locking mechanism bore 52 can be located proximate the ends of the base sides 44, and the rocker pin bore 54 can be located proximate the midpoint of base sides 44. It should be appreciated that the stopper bores 50 and the locking mechanism bore 52 can be located anywhere along the base sides 44 or the base ends 46.

The stoppers 48 can be rods 48 that can extend between the base sides 44 and can be adapted to limit the movement of the tilt rocker 36 as illustrated in FIG. 5. The stoppers 48 can be received and retained within the stopper bores 50. It should be appreciated that the stoppers 48 can be protrusions that couple with or be integrally formed with the base sides 44 and/or base ends 46. The stoppers 48 can prevent the tilt rocker 36 from rotating a magnitude of more than about 30° with respect to the tilt base 34 where the tilt rocker 36 and the tilt base 34 are at about 0° of rotation with respect to one another when the upper frame 14 is substantially parallel to the lower frame 12. It should be appreciated that the stoppers 48 can allow for more or less than a magnitude of 30° of rotation; however, the risk of the person supported on the upper frame 14 rolling and/or falling off of the upper frame 14 increases as the angle between the tilt rocker 36 and the tilt base 34 increases in magnitude.

The tilt rocker 36 can be coupled with the supports 16 and rotationally coupled with the tilt base 34 via the rocker pin 38 as illustrated in FIGS. 4 and 5. It should be appreciated that the tilt rocker 36 can be integrated into the supports 16. The tilt rocker 36 can include rocker sides 56, a rocker top 58, and a rocker bar 60. The rocker sides 56 can be integrally formed with the rocker top 58 to form a U-shape. It should be appreciated that the tilt rocker 36 can be integrally formed with the supports 16. It should be appreciated that the rocker sides 56 can couple with the rocker top 58 to form the U-shape. The rocker sides 56 can include a rocker pin bore 62, stopper engaging portions 64, and a rotational positioning portion 66. It should be appreciated that the rocker sides 56 can not include the rotational positioning portion 66 where the locking mechanism 40 cooperates with the tilt rocker 36 and tilt base 34 to maintain the orientation of the upper frame 14 with respect to the lower frame 12. The rocker pin bore 62 can be located proximate the center of the rocker sides 56 and can be concentrically aligned with the rocker pin bore 54 of the tilt base 34. The stopper engaging portions 64 can be located proximate the ends of the rocker sides 56 and engage the stoppers 48 to limit the motion of the tilt base 34 with respect to the tilt rocker 36.

The rotational positioning portion 66 includes positioning bores 68 that can be located proximate the locking mechanism bore 52 of the tilt base 34 when the rocker pin bore 62 of the tilt rocker 36 can be concentrically aligned with the rocker pin bore 54 of the tilt base 34 as illustrated in FIG. 5. The positioning bores 68 can be radially dispersed along an arc that can be concentric with an arc that the rocker pin bore 62 moves along as the tilt base 34 pivots with respect to the tilt rocker 36. The positioning bores 68 can be positioned such that the tilt base 34 can be maintained substantially stationary at an angle of at least one of about 0°, +10°, and −10° with respect to the tilt rocker 36 when the locking mechanism 40 engages the positioning bores 68. It should be appreciated that the positioning bores 68 can be positioned such that the tilt base 34 can held substantially stationary anywhere between about −30° and about +30° with respect to the tilt rocker 36.

The rocker bar 60 can be positioned within the U-shape formed by the rocker sides 56 and the rocker top 58 as shown in FIG. 5. It should be appreciated that the rocker bar 60 can be integrally formed with the rocker sides 56 and the rocker top 58 to form a U-shape. The rocker bar 60 can include a support bore 70 that can receive a fastener arrangement 72 that can couple the rocker bar 60 with one of the supports 16. It should be appreciated that the rocker bar 60 can be integrally formed with the supports 16. In one illustrative embodiment, the fastener arrangement can include a post FP1 extending from the supports 16 that can be received in one end of the support bore 70, a plurality of washers FW1 that can engage either end of the support bore 70, and a fastener FF1 that can be received in the other end of the support bore 70 and retained within the post FP1 to couple the rocker bar 60 to the supports 16. The support bore 70 can be positioned such that the center of the support bore 70 is substantially perpendicular to the rocker pivot axis R1 and substantially parallel to the vertical axis Z1.

The rocker pin 38 can include a rocker pin shaft 74 rotatably retained within rocker pin bearings 76 as illustrated in FIGS. 4 and 5. It should be appreciated that the rocker pin 38 can not include rocker pin bearings 76, and instead, the rocker pin bores 54 of the tilt base 34 and/or the rocker pin bores 62 of the tilt rocker 36 can be composed of bearing quality material, such as, nylon or other bearing quality materials, and/or can be lubricated with a lubricant, such as, graphite, oil, or other lubricants. The rocker pin bearings 76 can be removably mounted within the rocker pin bores 54 of the tilt base 34. It should be appreciated that the tilt rocker 36 can also have rocker pin bearings 76 mounted within the rocker pin bores 62 of the tilt rocker 36.

The locking mechanism 40 can be coupled with the base sides 44 and pass through the locking mechanism bore 52 in the tilt base 34 to engage the rotational positioning portion 66 of the tilt rocker 36 as shown in FIGS. 4 and 5. The locking mechanism 40 can lock the tilt base 34 at an angle of about 0°, +10°, and −10° with respect to the tilt rocker 36, where the tilt base 34 is at an angle of about 0° with respect to the tilt rocker 36 when the upper frame 14 is parallel the lower frame 12. It should be appreciated that the tilt base 34 can be pivoted such that the tilt base 34 is at an angle of between about −30° and about +30° with respect to the tilt rocker 36. It should also be appreciated that the locking mechanism 40 can lock the tilt base 34 with respect to the tilt rocker 36 at any position along an arcuate path traveled by the tilt base 34 as it pivots with respect to the tilt rocker 36 about the rocker pivot axis R1.

The locking mechanism 40 can including a locking shaft 78, a locking housing 80 with a locking shaft bore 82 therein, and a locking spring (not shown) at least partially positioned within the locking shaft bore 82 and engaging a portion of the locking shaft 78 as shown in FIGS. 4 and 5. In one illustrative embodiment, the locking mechanism 40 can be a manually actuated spring-loaded pin 40. It should be appreciated that the locking mechanism 40 can be a spring loaded plunger, a detent, a locating pin, an indexing pin, a fastener, a swell latch, a slotted latch or other locking mechanisms. It should also be appreciated that the locking mechanism 40 can be actuated by a cable, or can be electrically, pneumatically, or hydraulically actuated. It should be further appreciated that the stoppers 48 can be configurable to be a locking mechanism 40. It should be further appreciated that the locking mechanism 40 can be a locking gas spring, such as, the dampener 142, or a clutch system that allows an operator, i.e., a caregiver, to pivot the tilt base 34 with respect to the tilt rocker 36 and lock the tilt base 34 at any position along an arcuate path traveled by the tilt base 34 as it pivots with respect to the tilt rocker 36 about the rocker pivot axis R1.

To affect a locking function, the locking shaft 78 can extend through the locking mechanism bore 52 of the tilt base 34 into one of the positioning bores 68 of the tilt rocker 36 to prevent rotation of the tilt base 34 with respect to the tilt rocker 36, thereby preventing rotation of the upper frame 14 with respect to the supports 16 and the lower frame 12. To affect an unlocking function, the locking shaft 78 can be retracted from the positioning bores 68 of the tilt rocker 36 into the locking mechanism bore 52 of the tilt base 34 to allow rotation of the tilt base 34 with respect to the tilt rocker 36, which allows for rotation of the upper frame 14 with respect to the supports 16 and the lower frame 12.

The synchronization system 28 can couple with the locking mechanisms 40 of the tilt mechanisms 26 to synchronize actuation of the tilt mechanisms 26 as illustrated in FIGS. 2 and 3. The synchronization system 28 can include synchronizing linkages 84 and a synchronizing actuator 86. It should be appreciated that the synchronization system 28 can include more than one synchronizing actuator 86 and/or a single synchronizing linkage 84. The synchronization system 28 can be accessible from at least one side or end of the upper frame 14. The synchronizing system 28 can allow a user/caregiver to operate the tilt mechanisms 26 with one hand while using the other hand to assist the person supported on the person support apparatus 10.

The synchronizing linkages 84 can couple with the locking mechanisms 40 and the synchronizing actuator 86 as illustrated in FIGS. 2 and 3. It should be appreciated that the synchronizing linkages 84 can couple with multiple synchronizing actuators 86. It should also be appreciated that a single synchronizing linkage 84 can couple with multiple synchronizing actuators 86. In one illustrative embodiment, the synchronizing linkage 84 can be a cable 84. It should be appreciated that the synchronizing linkage 84 can be a cam shaft and linkage arrangement similar to the one shown in connection with the illustrative embodiment described below, a rack and pinion arrangement (not shown), an electronic controller and actuator arrangement (not shown), a hydraulic controller and actuator arrangement (not shown), a pneumatic controller and actuator arrangement (not shown), or combinations thereof.

The synchronizing actuator 86 can couple with the synchronizing linkages 84 and couple with a portion of the upper frame base 24 such that it can be accessible to an operator as illustrated in FIGS. 2 and 3. It should be appreciated that a synchronizing actuator 86 can couple with each of the locking mechanisms 40 with a synchronizing linkage 84 being coupled between the synchronizing actuators 86 such that if one of the synchronizing actuators 86 is actuated then both synchronizing actuators 86 actuate. It should also be appreciated that the synchronizing actuator 86 can couple with the lower frame 12, the supports 16, the footboard FB1, the headboard HB1, a side rail SR1, or other operator accessible areas. In one illustrative embodiment, the synchronizing actuator 86 can be a lever 86 adapted to be used with a cable 84. It should be appreciated that the synchronizing actuator 86 can be a manual crank wheel (not shown), an electrical, hydraulic, or pneumatic switch (not shown), a foot-pedal arrangement (not shown), or other actuator.

Describing now the operation of these various illustrative embodiments, the locking shafts 78 can be initially positioned such that the locking shafts 78 extend through the locking mechanism bores 52 into one of the positioning bores 68 to prevent rotation of the tilt bases 34 with respect to the tilt rockers 36. To pivot the upper frame 14 with respect to the lower frame 12 and the supports 16, an operator can manually actuate the synchronizing actuator 86, which can cause the locking mechanisms 40 to actuate. It should be appreciated that one of a plurality of synchronizing actuators 82 can be actuated to cause the other synchronizing actuators 82 and/or the locking mechanisms 40 to actuate. The actuation of the locking mechanisms 40 can move the locking shafts 78 out of the positioning bores 68 such that the locking shafts 78 no longer engage the positioning bores 68. Once the locking shafts 78 no longer engage the positioning bores 68, the tilt base 34 can be rotatable with respect to the tilt rocker 36. The operator can pivot the upper frame 14 about the rocker pivot axis R1 to laterally tilt the upper frame 14 with respect to the lower frame 12 and the supports 16.

As the tilt base 34 pivots with the upper frame 14, the engaging portions 64 can engage the stoppers 48 to limit the rotation of the upper frame 14 with respect to the lower frame 12 and the supports 16. Upon reaching a desired position, such as +15°, 0°, or −15°, the operator can actuate the synchronizing actuator 86, which can actuate the locking mechanism 40 and move the locking shafts 78 such that they are positioned within the positioning bores 68 to maintain the position of the upper frame 14 with respect to the lower frame 12 and the supports 16. It should be appreciated that the synchronizing actuator 86 can remain actuated while the upper frame 14 is pivoted with respect to the lower frame 12 and the supports 16 and the be released upon reaching a desired position to maintain the position of the upper frame 14 with respect to the lower frame 12 and the supports 16.

A person support apparatus 110 according to another illustrative embodiment of the current disclosure is shown in FIGS. 6-14, wherein like numerals refer to like features previously described. The person support apparatus 110 can include a lower frame 12, an upper frame 114, and supports 16 coupled with the lower frame 12 and the upper frame 114. The upper frame 114 can include longitudinal frame members 22, lateral frame members 24, tilt mechanisms 126, and a synchronization system 128 for synchronizing actuation of the tilt mechanisms 126. It should be appreciated that the synchronization system 128 can not be included, and instead, the tilt mechanisms 126 can be actuated independently or simultaneously by one or more operators.

Figures 6, 7:
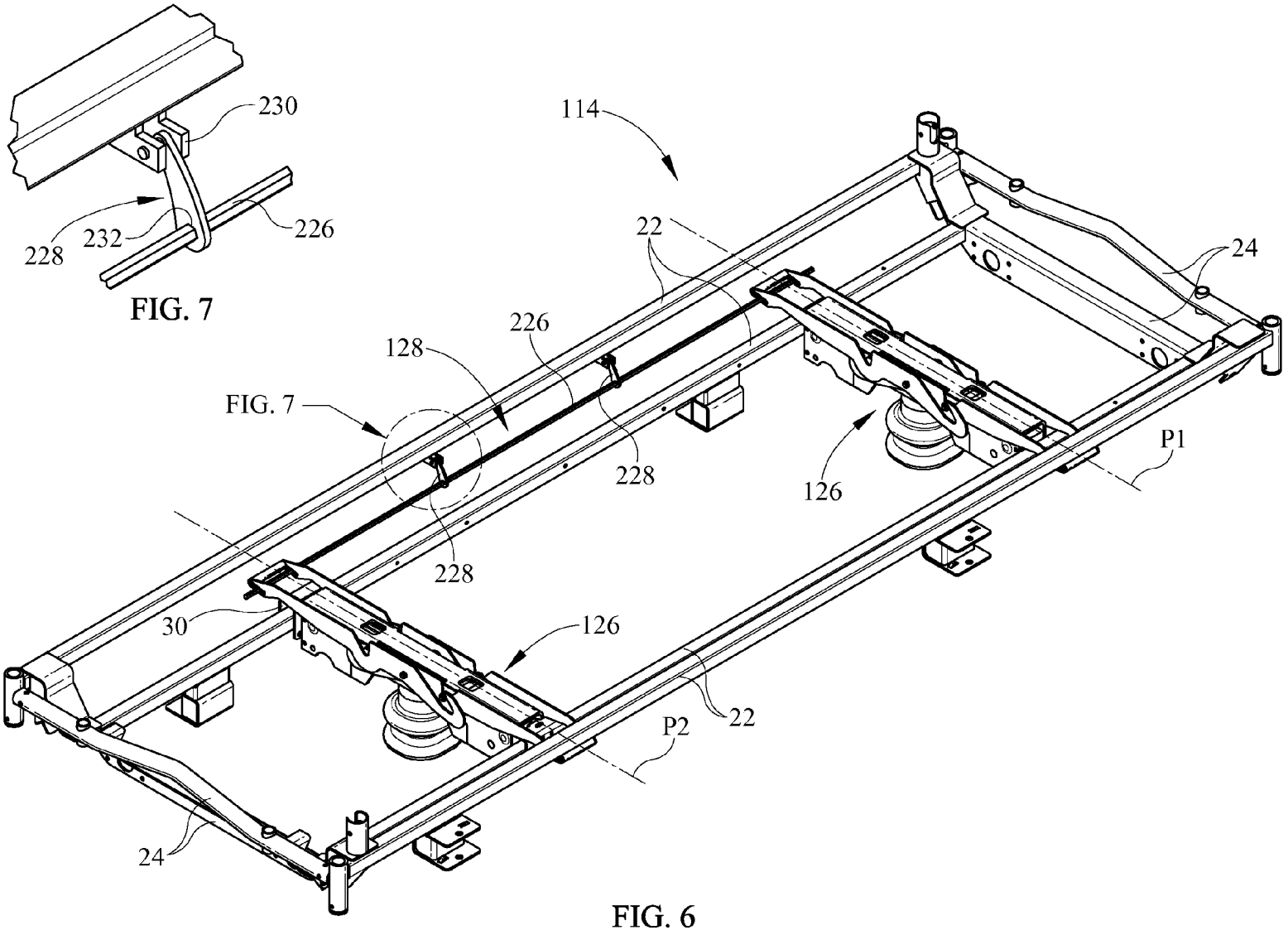
FIG. 6 is a perspective side view of a tilt mechanism including a dampener according to another illustrative embodiment of the current disclosure.
FIG. 7 is a zoom view of the synchronization system of FIG. 6.

The tilt mechanisms 126 can be coupled to the supports 16 and can pivotably couple the upper frame 114 to the supports 16 as illustrated in FIG. 6. The tilt mechanisms 126 can be pivotably coupled to the upper frame 114 and at least one of the tilt mechanisms 126 can be pivotably coupled to a trolley 30 that can move with respect to the upper frame 114. In one illustrative embodiment, one of the tilt mechanisms 126 can be pivotably coupled to the upper frame 14 via a pin 32 to define a first pivot axis P1, and another of the tilt mechanisms 126 can be pivotably coupled to the trolley 30 via a pin 32 to define a second pivot axis P2.

Figure 11:
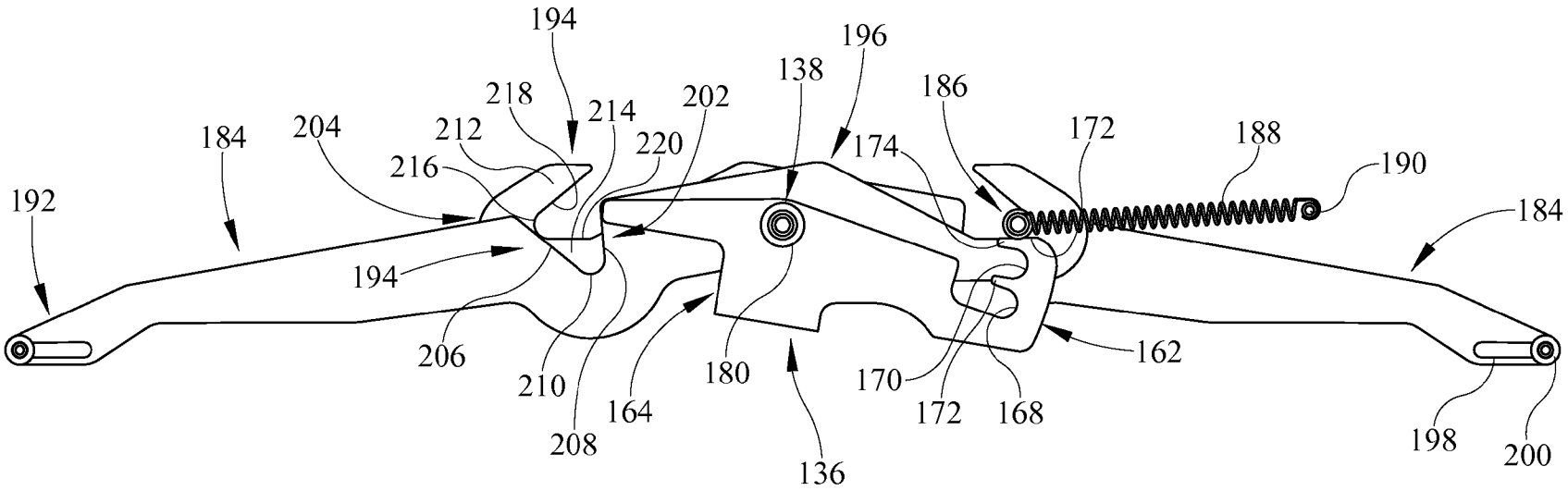
FIG. 11 is a side plan view of the locking mechanism and tilt rocker of FIG. 6 locked in a pivoted position utilizing the upper positioning surface.
Figure 12:
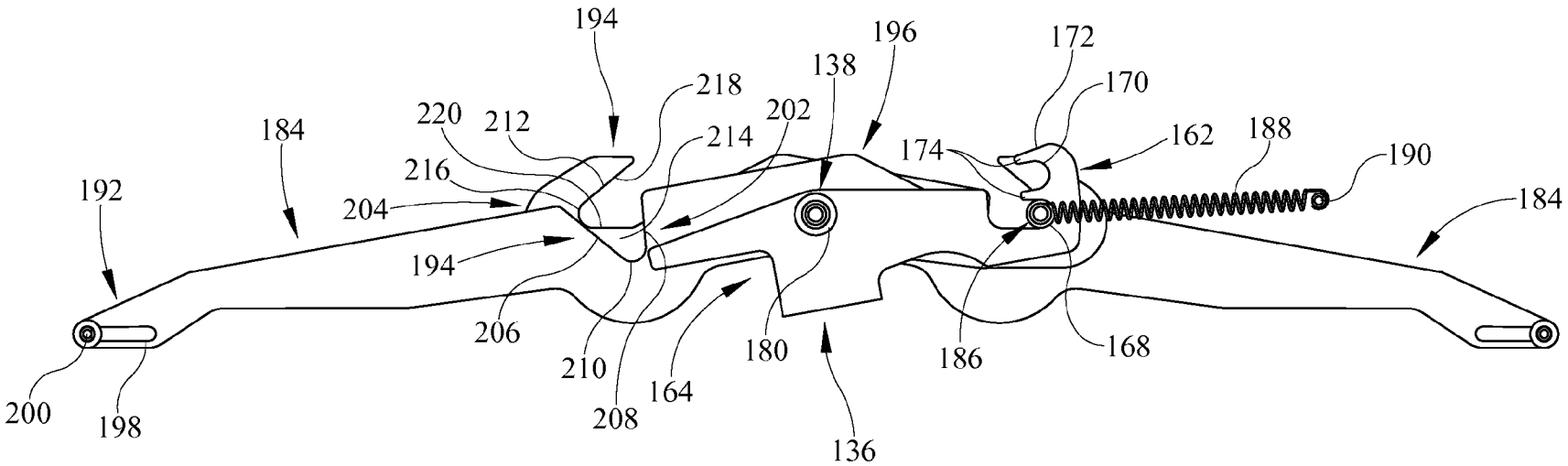
FIG. 12 is a side plan view of the locking mechanism and tilt rocker of FIG. 6 in locked in a pivoted position utilizing the lower positioning groove.
Figure 13:
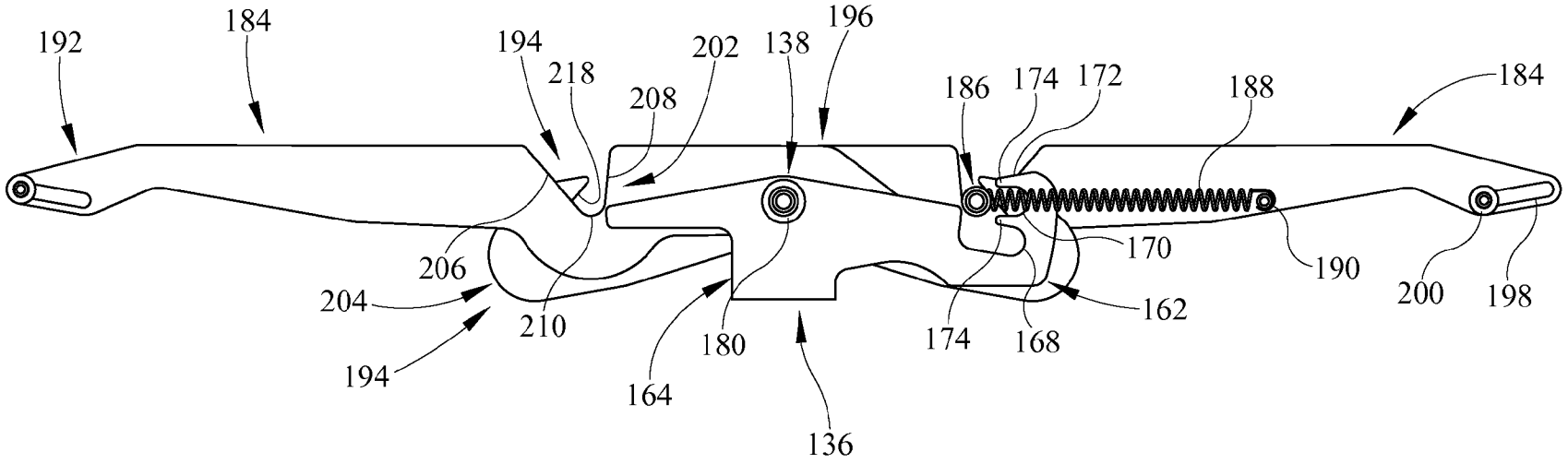
FIG. 13 is a side plan view of the locking mechanism and tilt rocker of FIG. 6 unlocked in a horizontal position.

The tilt mechanisms 126 can include a tilt base 134, a tilt rocker 136, a rocker pin 138, and a locking mechanism 140 as illustrated in FIGS. 6-14. The tilt rocker 136 and the tilt base 134 can be coupled together by way of the rocker pin 38. The tilt base 134 can be pivotable with respect to the tilt rocker 136 when the locking mechanism 140 is in an unlocked position as shown in FIG. 13, and the tilt base 134 can be substantially stationary with respect to the tilt rocker 136 when the locking mechanism 140 is in a locked position as shown in FIGS. 12-13. The tilt base 134 can pivot between about −10° and +10° about the rocker pivot axis R2 with respect to the tilt rocker 136. It should be appreciated that the tilt base 134 can pivot between a magnitude of about 30° about the rocker pivot axis R2 with respect to the tilt rocker 136, where the tilt base 134 is at an angle of about 0° with respect to the tilt rocker 136 when the upper frame 114 is parallel the lower frame 12. It should also be appreciated that the tilt base 134 can pivot more than a magnitude of about 30° about the rocker pivot axis R2 with respect to the tilt rocker 136. In one illustrative embodiment, the tilt mechanism 126 can include a dampener 142 that can be coupled with the tilt rocker 136 and the tilt base 134 to resist rotation of the tilt base 134 with respect to the tilt rocker 136 as shown in FIG. 14. It should be appreciated that the dampener 142 can be configured to operate as the locking mechanism 140, for example, the dampener 142 can be a gas locking dampener 142. It should also be appreciated that the resistance of the dampener 142 can increase as the speed of the rotation of the tilt base 134 with respect to the tilt rocker 132 increases.

Figure 8:
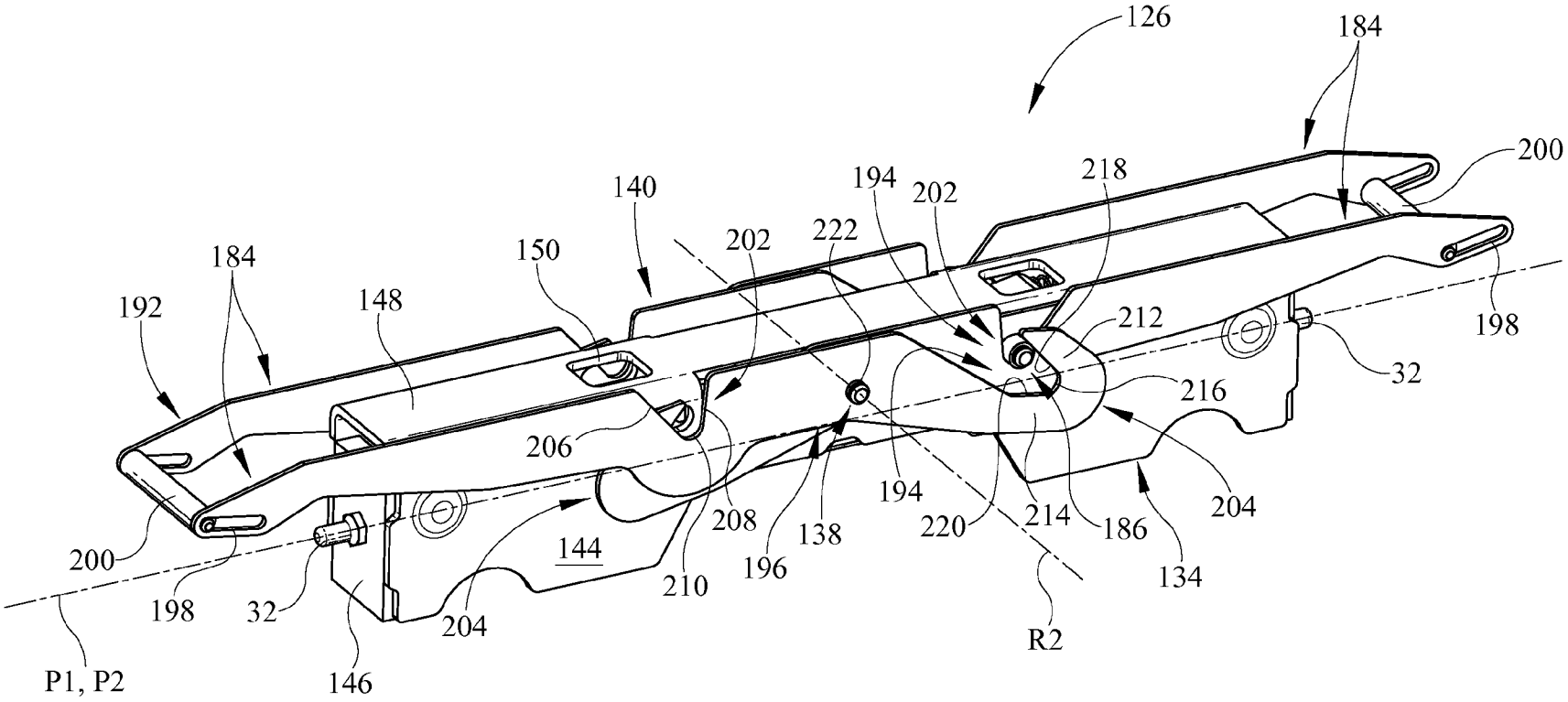
FIG. 8 is a perspective side view of the tilt mechanisms of FIG. 6.
Figure 9:
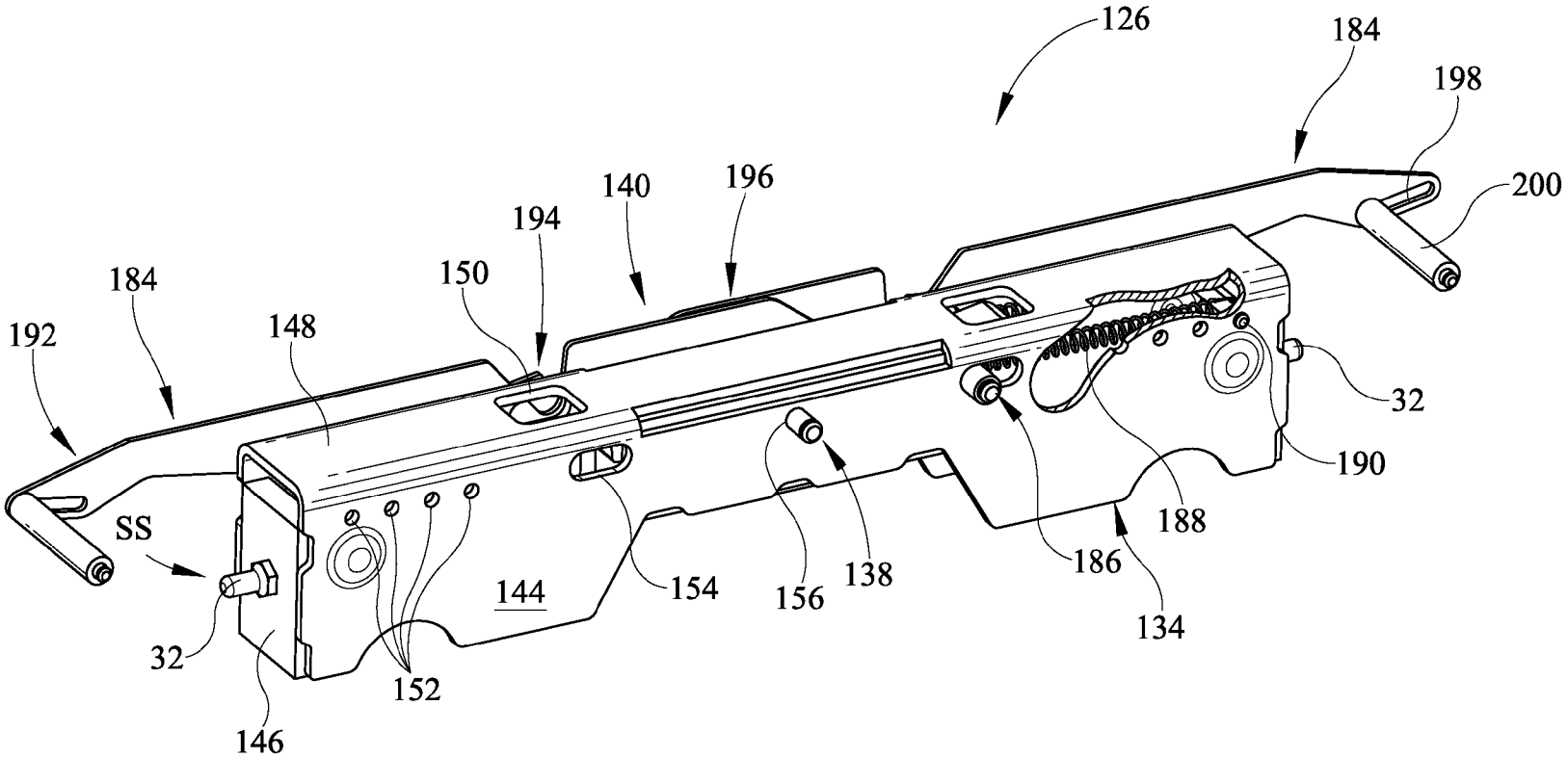
FIG. 9 is a partial cutaway perspective side view of the tilt mechanisms of FIG. 6 illustrating the tilt base and locking mechanism
Figure 10:
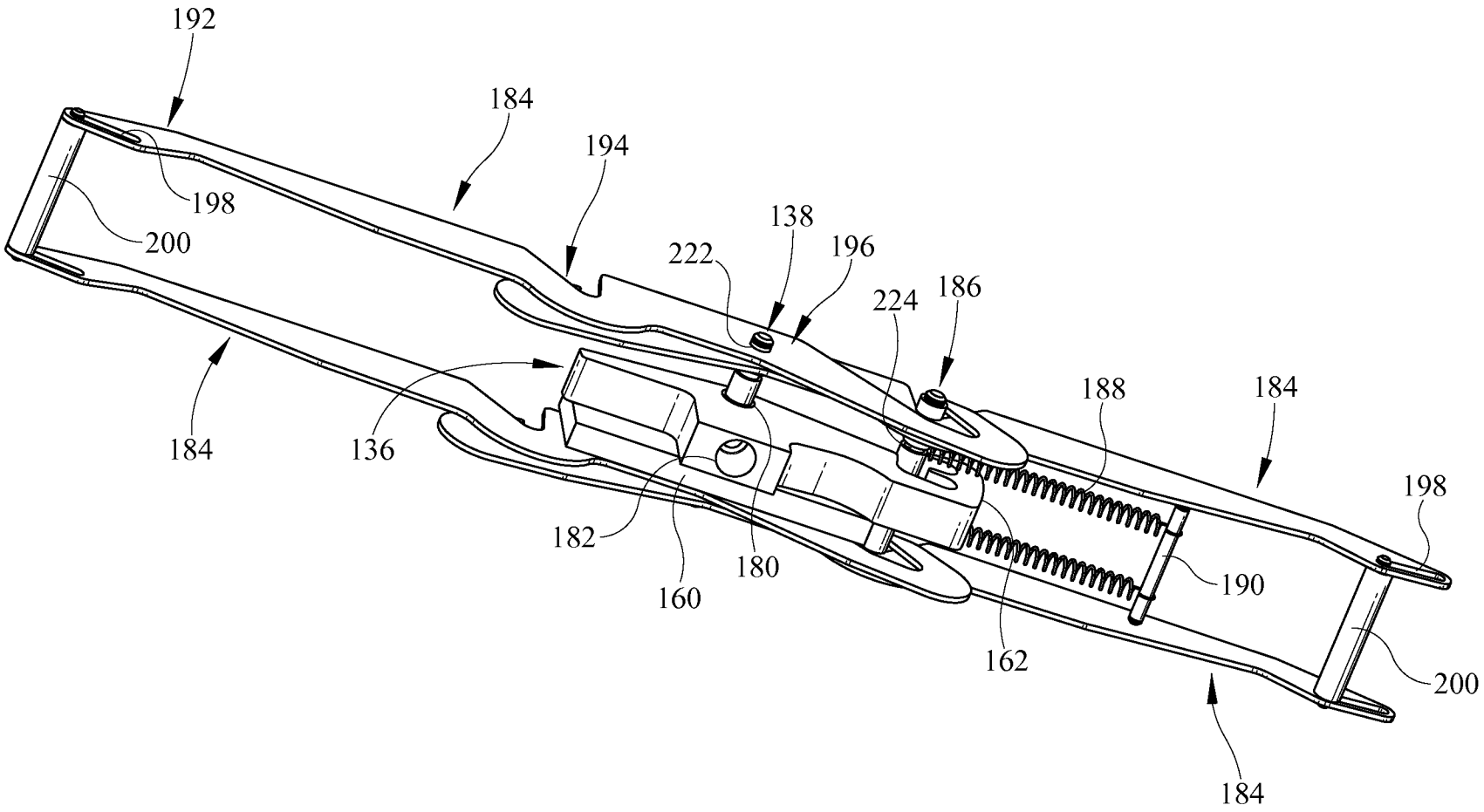
FIG. 10 is a perspective bottom view of the tilt mechanisms of FIG. 6 illustrating the tilt rocker and locking mechanism.

The tilt base 134 can include base sides 144, base ends 146, and a base top 148 as shown in FIGS. 8 and 9. The base sides 144 can couple with the base top 148 to form a U-shape, and the base ends 146 can couple with the ends of the base sides 144 and the base top 148 to form a generally rectangular box. The base top 148 can include top openings 150 therein that can provide clearance for the tilt rocker 136 when the tilt base 132 pivots with respect to the tilt rocker 134. It should be appreciated that the top openings 150 can be adapted to limit the rotation of the tilt base 134 with respect to the tilt rocker 136. The base sides 144 can include locking tensioner bores 152, locking pin slots 154, and a rocker pin bore 156. It should be appreciated that the base sides 144 can not include locking tensioner bores 152. The locking tensioner bores 152 can be positioned proximate the base top 148 and the base ends 146; the rocker pin bore 156 can be positioned proximate the center of the base sides 144 and the base top 148, and the locking pin slots 154 can be positioned between the locking tensioner bores 152 and the rocker pin bore 156.

The tilt rocker 136 can include spacers 160, a positioning portion 162, and a rotation portion 164 as illustrated in FIGS. 10-14. It should be appreciated that the tilt rocker 136 can be integrally formed with the supports 16. It should also be appreciated that the tilt rocker 136 can include multiple positioning potions 162. It should further be appreciated that the tilt rocker 136 can include a locking gas spring or a clutch system instead of the positioning portion 162, which could allow an operator, i.e., a caregiver, to pivot the tilt base 134 with respect to the tilt rocker 136 and lock the tilt base 134 at any position along an arcuate path traveled by the tilt base 134 as it pivots with respect to the tilt rocker 136 about the rocker pivot axis R2. The spacers 160 can space the positioning portions 162 and the rotation portion 164 apart from the tilt base 34. The spacers 160 can include rocking pin bores 166 that can be concentrically aligned with the rocker pin bores 154 of the tilt base 134.

The positioning portion 162 can be located at an end of the tilt rocker 136 and the rotation portion 164 can be located proximate the center of the tilt rocker 136 as illustrated in FIGS. 10-14. The positioning portions 162 can maintain the upper frame 114 in a desired orientation with respect to the supports 16 and the lower frame 12. The positioning portions 162 can be generally hook-shaped and can include a lower positioning groove 168, a middle positioning groove 170, an upper positioning surface 172, and separating portions 174 that can be positioned between the lower positioning groove 168 and the middle positioning groove 170 and the upper positioning surface 172. It should be appreciated that the positioning portions 162 can be other shapes and can include additional positioning grooves and/or surfaces. It should also be appreciated that the separating portions 174 can be rounded and/or sloped, which can allow for an easier transition between the lower positioning groove 168, the middle positioning groove 170, and the upper positioning surface 172.

When the middle positioning groove 170 is positioned such that the rocker pin 138 is located in the middle positioning groove 170 or in approximately the same horizontal plane as the middle positioning groove 170, the upper frame 114 can be maintained substantially perpendicular the supports 16 and parallel the lower frame 12, i.e., 0° of rotation, as illustrated in FIG. 13. When the lower positioning groove 168 is positioned such that the rocker pin 138 is located in the lower positioning groove 168 or in approximately the same horizontal plane as the lower positioning groove 168, the upper frame 114 can be maintained at approximately −10° rotation with respect to the supports 16 and the lower frame 12 as illustrated in FIG. 12. When the upper positioning surface 172 is positioned such that the rocker pin 138 is in contact with the upper positioning surface 172 or in approximately the same horizontal plane as the upper positioning surface 172, the upper frame 114 can be maintained at approximately +10° rotation with respect to the supports 16 and the lower frame 12 as illustrated in FIG. 11.

The rotation portion 164 can include a rocker pin bore 180 and a support bore 182 as illustrated in FIGS. 11-13. The rocker pin bore 180 can be concentrically aligned with the rocking pin bore 156 of the tilt base 134. The rocker pin bore 180 can receive and retain the rocker pin 138 therewithin. The support bore 182 can receive a fastener arrangement 72 that can couple the tilt rocker 136 with one of the supports 16. It should be appreciated that the support 16 could be threaded directly into the support bore 182. It should be appreciated that the fastener FF1 could be a set screw or bolt without a head thereon so that the tilt rocker 136 can extend completely through the tilt mechanism 126.

The locking mechanism 140 includes locking arms 184, locking pin 186, locking springs 188, and locking tensioner 190 as illustrated in FIGS. 9-13. The locking arms 184 can be rotatably coupled with the tilt base 134 and can be used to actuate the locking mechanism 140 and pivot the upper frame 14 about the rocker pivot axis R2. The locking arms 184 can be pivoted in a first direction to actuate the locking mechanism 140 and move the locking pin 186 to an unlocked position, as shown in FIG. 13, where the locking pin 186 does not engage the positioning portions 162 of the tilt rocker 136 and the tilt base 134 can be pivotable with respect to the tilt rocker 136. The locking arms 184 can be pivoted in a second direction to actuate the locking mechanism 140 and move the locking pin 186 to an locked position, as shown in FIGS. 11-12, such that the locking pin 186 engages one of the positioning portions 162 of the tilt rocker 136 and maintains the tilt base 134 substantially stationary with respect to the tilt rocker 136.

The locking arms 184 can include a grip portion 192, locking pin guides 194, and a rocker pin portion 196 as illustrated in FIGS. 8 and 10-14. The grip portion 192 can include a grip slot 198 that receives a grip 200. It should be appreciated that the grip portion 192 can include a grip bore (not shown) instead of the grip slot 198. The grip 200 can be a bar that can extend substantially between the locking arms 184 and can be retained within the grip slot 198. The grip 200 can be adjustable to move within the grip slot 198.

The locking pin guides 194 can include a notch guide 202 and a hook guide 204 as illustrated in FIGS. 8 and 10-14. The notch guide 202 of one locking arm 184 can be positioned adjacent the hook guide 204 of another locking arm 184 such that the angled guide of the one locking arm 184 can cooperate with the hook guide 204 of the other locking arm 184 to maintain the engagement of the locking pin 186 with the notch guide 202 and the hook guide 204.

The notch guide 202 can include a first angled surface 206 and a second angled surface 208 as illustrated in FIGS. 8 and 10-14. The first angled surface 206 and the second angled surface 208 can be connected at a notch guide base 210. The first angled surface 206 can be engaged by the locking pin 186 in a locked position and an unlocked position, while the second angled surface 208 can engage the locking pin 186 in the unlocked position. To achieve an unlocked position, the locking arms 184 can be pivoted about the rocker pivot axis R2 in the first direction to move the locking pin 186 along the first angled surface 206 toward the notch guide base 210 where the locking pin 186 can engage both the first angled surface 206 and the second angled surface 208 in the unlocked position. To achieve a locked position, the locking arms 184 can be pivoted about the rocker pivot axis R2 in the second direction to move the locking pin 186 along the first angled surface 206 away from the notch guide base 210 where the locking pin 186 only engages the first angled surface 206 in the locked position.

The hook guide 204 can include a curved portion 212 and a shank portion 214. It should be appreciated that the hook guide 204 can include an angled portion 212 instead of the curved portion 212 as illustrated in FIGS. 8 and 10-14. The curved portion 212 can extend from the shank portion 214 at the hook guide base 216. The curved portion 212 can include a curved surface 218 that can engage the locking pin 186 in a locked position and an unlocked position, while the shank portion 214 can include a shank surface 220 that can engage the locking pin 186 in the unlocked position. To achieve an unlocked position, the locking arms 184 can be pivoted about the rocker pivot axis R2 in the first direction to move the locking pin 186 along the curved surface 218 away from the hook guide base 216 where the locking pin 186 only engages the curved surface 218 in the locked position, as shown in FIGS. 11 and 12. To achieve a locked position, the locking arms 184 can be pivoted about the rocker pivot axis R2 in the second direction to move the locking pin 186 along the curved surface 218 toward the hook guide base 216 where the locking pin 186 can engage both the curved surface 218 and the shank surface 220 in the unlocked position, as shown in FIG. 13.

The rocker pin portion 196 can include a rocker pin bore 222 that is adapted to receive the rocker pin 138 as illustrated in FIGS. 8 and 10-14. It should be appreciated that the rocker pin portion 196 can include a protrusion (not shown) instead of the rocker pin bore 222, where the protrusion engages the tilt base 134 to pivot the locking arms 184 with respect to the tilt base 134. It should also be appreciated that the rocker pin portion 196 can include a retainer (not shown) that retains the rocker pin 138 within the rocker pin bore 222.

The locking pin 186 can extend through the locking pin slots 154 of the tilt base 134 and can engage the locking pin guides 194 of the locking arms 184 and the positioning portion 162 of the tilt rocker 136 as illustrated in FIGS. 8 and 10-14. It should be appreciated that at least a portion of the locking pin 186, locking pin guides 194, and/or the locking pin slots 154 can be composed of bearing quality material, such as, nylon or other bearing quality materials, and/or can be lubricated with a lubricant, such as, graphite, oil, or other lubricants. The locking pin 186 can include spring grooves 224 that retain an end of the locking springs 188 therein.

The locking springs 188 can be extension springs that couple with the locking tensioner 190 and the locking pin 186 shown in FIGS. 9-13. It should be appreciated that the locking springs 188 can be elastic bands, such as, rubber bands. It should also be appreciated that a single locking spring 188 can be used. The locking springs 188 can pull the locking pin 186 toward the locking tensioner 190 to maintain the engagement of the locking pin 186 with the positioning portion 162.

The locking tensioner 190 can extend between a pair of the locking tensioner bores 152 of the tilt base 134 and can be engaged by the locking springs 188 as illustrated in FIGS. 9-13. The locking tensioner 190 can be a solid rod that is removably retained within one pair of the locking tensioner bores 152, and which can be re-positioned between another pair of the locking tensioner bores 152 to increase or decrease the amount of tension in the locking springs 188. It should be appreciated that the locking tensioner 190 can be integrally formed with the tilt base 134. The locking tensioner 190 can include spring grooves (not shown) that retain an end of the locking springs 188 therein.

The synchronization system 128 can couple with the locking mechanisms 140 of the tilt mechanisms 126 and the longitudinal frame members 22 of the upper frame 114 to synchronize actuation of the tilt mechanisms 126 as illustrated in FIGS. 6 and 7. The synchronization system 128 can include synchronizing linkages 226 and synchronizing cams 228. It should be appreciated that the synchronization system 128 can not include synchronizing cams 228 if the space between the grip portion 194 of the locking arms 182 is increased and/or the distance between the tilt mechanisms 126 is decreased. The synchronization system 128 can be accessible from both sides of the upper frame 114. The synchronizing system 128 can allow a user/caregiver to operate the tilt mechanisms 126 with one hand while using the other hand to assist the person supported on the person support apparatus 110.

The synchronizing linkages 226 can be hex-bars 226 that can extend through the grip slots 198 of the locking arms 184 and be movable within the grip slots 198 as illustrated in FIGS. 6 and 7. It should be appreciated that the synchronizing linkages 226 can be a rod or tube or other rigid elongated member, and can be curved, triangular, polygonal, or other shapes. It should also be appreciated that the synchronizing linkages 226 can be cables as described above. The synchronizing linkages 226 can simultaneously actuate the locking arms 184 as the synchronizing linkages 226 are moved along the vertical axis Z1.

The synchronizing cams 228 can engage the synchronizing linkages 226 and can cause the synchronizing linkages 226 to move substantially uniformly with respect to the longitudinal frame members 22 as illustrated in FIGS. 6 and 7. The synchronizing cams 228 can include an upper frame coupler 230 and a synchronizing linkage bore 232. The upper frame coupler 230 can be rotatably coupled with the longitudinal frame members 22 of the upper frame base 126 between the tilt mechanisms 126. It should be appreciated that the synchronizing cams 228 can be coupled with the longitudinal frame members 22 anywhere along the longitudinal frame members 22. The synchronizing linkage bore 232 can rotatably engage the synchronizing linkages 226.

Describing now the operation of these various illustrative embodiments, the upper frame 114 can be initially positioned such that the upper frame 114 is substantially parallel the lower frame 12, i.e., at approximately 0° of rotation. In this position the locking arms 184 can be positioned such that the locking pin 186 can be located within the middle positioning groove 170, thereby preventing rotation of the tilt base 134 with respect to the tilt rocker 136 and maintaining the orientation thereof.

In order to pivot the upper frame 114 with respect to the supports 16 and the lower frame 12, the locking arms 184 can be actuated to move the locking pin 186 out of the middle positioning groove 170 to the unlocked position. The locking arms 184 can be actuated by an operator gripping the synchronizing linkage 226 and the longitudinal frame member 22 coupled with the synchronizing cam 228, and moving the synchronizing linkage 226 toward the longitudinal frame member 22. It should be appreciated that the operator can grip the synchronizing linkage 226 to move the synchronizing linkage 226 toward the longitudinal frame member 22 coupled with the synchronizing cam 228. As the locking arms 184 are actuated, the notch guide 202 and the hook guide 204 can cooperate to urge the locking pin 186 along the first angled surface 206 of the notch guide 202 toward the notch guide base 210 and along the curved portion 212 of the hook guide 204 away from the hook guide base 216, thereby causing the locking pin 186 to move from the locked position within the middle positioning groove 170 to the unlocked position out of the middle positioning groove 170.

Once the locking pin 186 is in the unlocked position, the tilt base 134 can be free to pivot with respect to the tilt rocker 136, allowing the operator to manually pivot the upper frame 114 with respect to the supports 16 and the lower frame 12. The locking arms 184 can be maintained in the actuated position as the upper frame 114 is pivoted with respect to the lower frame 12 and the supports 16.

In order to substantially maintain the orientation of the upper frame 114 with respect to the lower frame 12 and the supports 16 upon the upper frame 114 reaching a desired angle of rotation, the user can release the synchronizing linkage 226 to actuate the locking arms 184 and move the locking pin 186 from the unlocked position to the locked position. It should be appreciated that the operator can move the synchronizing linkage 226 away from the longitudinal frame member 22 to actuate the locking arms 184 and move the locking pin 186 to the locked position. As the locking arms 184 are actuated, the notch guide 202 and the hook guide 204 can cooperate to urge the locking pin 186 along the first angled surface 206 of the notch guide 202 away from the angle guide base 210 and along the curved portion 212 of the hook guide 204 toward the hook guide base 216, thereby causing the locking pin 186 to move from the unlocked position outside the positioning grooves/surface 168, 170, 172 to the locked position engaging one of the positioning grooves/surface 168, 170, 172.

Many other embodiments of the present disclosure are also envisioned. For example, a person support apparatus comprises a lower frame, a support coupled to the lower frame, and an upper frame. The upper frame has a head section and a foot section and defines a longitudinal axis passing through the head section and the foot section and a lateral axis substantially perpendicular to the longitudinal axis. The upper frame includes a tilt mechanism that pivotably couples the upper frame to the support. The tilt mechanism includes a force sensor and defines a pivot axis. The upper frame is pivotable about the pivot axis with respect to the lower frame.

In another example, a person support apparatus comprises a lower frame, a plurality of supports coupled to the lower frame, an upper frame, and a synchronization system. The upper frame has a head section and a foot section and defines a longitudinal axis passing through the head section and the foot section and a lateral axis substantially perpendicular to the longitudinal axis. The upper frame includes a plurality of tilt mechanisms that pivotably couple the upper frame to the supports. The tilt mechanisms are coaxially aligned and define a pivot axis. The pivot axis is substantially parallel the longitudinal axis. The upper frame is pivotable about the pivot axis with respect to the lower frame. The synchronization system is configured to actuate the tilt mechanisms substantially simultaneously to one of change and maintain the lateral orientation of the upper frame with respect to the lower frame.

In yet another example, a person support apparatus comprises a lower frame, a support coupled to the lower frame, and an upper frame. The upper frame has a head section and a foot section and defines a longitudinal axis passing through the head section and the foot section and a lateral axis substantially perpendicular to the longitudinal axis. The upper frame includes a tilt mechanism pivotably coupling the upper frame to the support. The tilt mechanism defines a pivot axis and translates generally along the pivot axis with respect to the upper frame as the upper frame pivots about the pivot axis with respect to the lower frame.

In still another example, a person support apparatus comprises a lower frame, a support coupled to the lower frame, and an upper frame. The upper frame has a head section and a foot section and defines a longitudinal axis passing through the head section and the foot section and a lateral axis substantially perpendicular to the longitudinal axis. The upper frame includes a tilt mechanism that pivotably couples the upper frame to the support. The tilt mechanism includes a base and a rocker nested within the base. The base and the rocker are pivotable with respect to one another about a pivot axis that passes through the base and the rocker and is substantially parallel the longitudinal axis. The upper frame is pivotable about the pivot axis with respect to the lower frame.

In still another example, a person support apparatus comprises a lower frame, a support coupled to the lower frame, and an upper frame. The upper frame has a head section and a foot section and defines a longitudinal axis passing through the head section and the foot section and a lateral axis substantially perpendicular to the longitudinal axis. The upper frame includes a tilt mechanism that is pivotably coupled to the upper frame and that pivotably couples the upper frame to the supports. The tilt mechanism defines a first pivot axis generally parallel the lateral axis and a second pivot axis generally parallel the longitudinal axis. The tilt mechanism is pivotable about the first pivot axis with respect to the upper frame when the upper frame is moved between a Trendelenburg position and a reverse Trendelenburg position. The upper frame is manually pivotable about the second pivot axis with respect to the lower frame.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described may be more desirable, it nonetheless may not be necessary and embodiments lacking the same may be contemplated as within the scope of the disclosure, that scope being defined by the claims that follow. In reading the claims it is intended that when words such as "a," "an," "at least one," "at least a portion" are used there is no intention to limit the claim to only one item unless specifically stated to the contrary in the claim. When the language "at least a portion" and/or "a portion" is used the item may include a portion and/or the entire item unless specifically stated to the contrary. While embodiments of the disclosure have been illustrated and described in detail in the drawings and foregoing description, the same are to be considered as illustrative and not restrictive in character, it being understood that only the selected embodiments have been shown and described and that all changes, modifications and equivalents that come within the spirit of the disclosure as defined herein or by any of the following claims are desired to be protected.

What is claimed is:

1. A person support apparatus, comprising:

a lower frame;

a first support and a second support including a first end coupled to the lower frame;

an upper frame having a head section and a foot section and defining a longitudinal axis passing through the head section and the foot section and a lateral axis substantially perpendicular to the longitudinal axis; and a tilt mechanism that is movably coupled to the upper frame and pivotably couples the upper frame to a second end of the first support and the second support to allow a user to selectively manually rotate the upper frame with respect to the first support and the second support and the lower frame, the tilt mechanism defining a first pivot axis and being configured to translate generally along the first pivot axis with respect to the upper frame as the upper frame moves between a Trendelenburg position and reverse Trendelenburg position with respect to the lower frame, wherein the first pivot axis is substantially parallel the longitudinal axis and a second pivot axis is substantially parallel to the lateral axis, the tilt mechanism having a manually actuatable locking mechanism coupled thereto and configured to substantially maintain an orientation of the upper frame with respect to the lower frame when the locking mechanism is in a locked position and permit movement of the upper frame with respect to the lower frame about the first pivot axis when the locking mechanism is in an unlocked position, wherein the tilt mechanism includes a base coupled to the upper frame and a rocker coupled to at least one of the first support and the second support and rotatably coupled to the base, the locking mechanism including a pin that selectively engages the base and the rocker to substantially prevent movement of the rocker with respect to the base to maintain an orientation of the upper frame with respect to the lower frame.

2. The person support apparatus of claim 1, wherein the tilt mechanism is pivotable about the second pivot axis with respect to the upper frame.

3. The person support apparatus of claim 1, wherein the upper frame is movable between a supine position and a chair position.

4. The person support apparatus of claim 1, wherein the tilt mechanism includes a force sensor configured to sense a force on the upper frame.

5. The person support apparatus of claim 1, wherein the tilt mechanism includes a dampener configured to adjust the rate of rotation of the upper frame with respect to the lower frame.

6. The person support apparatus of claim 1, wherein the rocker is nested within the base.

7. A person support apparatus, comprising:

a lower frame;

a lift mechanism including a first end fixedly secured to the lower frame;

an upper frame having a head section and a foot section and defining a longitudinal axis passing through the head section and the foot section and a lateral axis substantially perpendicular to the longitudinal axis; and a tilt mechanism pivotably coupled to the upper frame and pivotably coupling the upper frame to a second end of the lift mechanism and configured to permit a user to selectively manually pivot the upper frame with respect to the lift mechanism and the lower frame, the tilt mechanism defining a first pivot axis generally parallel the lateral axis and a second pivot axis generally parallel the longitudinal axis, the tilt mechanism being pivoted about the first pivot axis with respect to the upper frame when the lift mechanism moves the upper frame between a Trendelenburg position and a reverse Trendelenburg position, the upper frame being manually pivotable about the second pivot axis with respect to the lower frame upon activation of the manually activated tilt mechanism, wherein a manually actuatable locking mechanism is coupled to the tilt mechanism and is configured to substantially maintain an orientation of the upper frame with respect to the lower frame about the second pivot axis when the locking mechanism is in a locked position and permits movement of the upper frame with respect to the lower frame when the locking mechanism is in an unlocked position, wherein the tilt mechanism includes a base coupled to the upper frame and a rocker coupled to the lift mechanism and rotatably coupled to the base, the locking mechanism including a pin that selectively engages the base and the rocker to substantially prevent movement of the rocker with respect to the base to maintain an orientation of the upper frame with respect to the lower frame.

8. The person support apparatus of claim 7, wherein the tilt mechanism includes a dampener configured to adjust the rate of rotation of the upper frame with respect to the lower frame.

9. The person support apparatus of claim 7, wherein the tilt mechanism includes a force sensor.

10. The person support apparatus of claim 7, wherein the first pivot axis is translatable generally along the longitudinal axis with respect to the upper frame when the upper frame is moved between a Trendelenburg position and a reverse Trendelenburg position.

11. The person support apparatus of claim 7, wherein the rocker is nested within the base.

12. A person support apparatus, comprising:

a lower frame;

a support coupled to the lower frame;

an upper frame including a longitudinal axis extending substantially along the length of the upper frame and a lateral axis extending substantially along the width of the upper frame and being substantially perpendicular to the longitudinal axis; and a tilt mechanism pivotably coupled to the upper frame and pivotably coupling the upper frame to the support to permit a user to selectively manually pivot the upper frame with respect to the support and the lower frame, the tilt mechanism defining a first pivot axis and a second pivot axis and being configured to rotate the upper frame laterally independent of any movement of the upper frame caused by the support, wherein the first pivot axis is substantially parallel to the longitudinal axis and the second pivot axis is substantially parallel to the lateral axis, the tilt mechanism having a manually actuatable locking mechanism coupled thereto and configured to substantially maintain an orientation of the upper frame with respect to the lower frame when the locking mechanism is in a locked position and permit movement of the upper frame with respect to the lower frame when the locking mechanism is in an unlocked position, wherein the tilt mechanism includes a base coupled to the upper frame and a rocker coupled to the support and rotatably coupled to the base, the locking mechanism including a pin that selectively engages the base and the rocker to substantially prevent movement of the rocker with respect to the base to maintain an orientation of the upper frame with respect to the lower frame.

13. The person support apparatus of claim 12, wherein the tilt mechanism is manually actuated.

14. The person support apparatus of claim 12, wherein the tilt mechanism includes a dampener configured to adjust the rate of rotation of the upper frame with respect to the lower frame.

15. The person support apparatus of claim 12, wherein the tilt mechanism is translatable generally along the first pivot axis with respect to the upper frame.

16. The person support apparatus of claim 12, wherein the upper frame is configured to be moved between a Trendelenburg and reverse Trendelenburg position.

17. The person support apparatus of claim 12, wherein the tilt mechanism includes a force sensor.

18. The person support apparatus of claim 12, wherein the rocker is nested within the base the base.

19. A person support apparatus, comprising:

a lower frame;

a lift mechanism including a first end fixedly secured to the lower frame;

an upper frame having a head section and a foot section and defining a longitudinal axis passing through the head section and the foot section and a lateral axis substantially perpendicular to the longitudinal axis; and a tilt mechanism pivotably coupled to the upper frame and pivotably coupling the upper frame to a second end of the lift mechanism to allow a user to selectively manually rotate the upper frame with respect to the lift mechanism and the lower frame, the tilt mechanism includes a base and a rocker nested within the base and a manually actuatable locking mechanism coupled to one of the rocker and the base, the base and the rocker being pivotable with respect to one another to allow the upper frame to pivot with respect to the lower frame and lift mechanism, the locking mechanism configured to selectively engage the rocker and the base to prevent movement of the rocker with respect to the base, wherein the locking mechanism includes a pin configured to engage an opening in both the base and the rocker to prevent movement of the base with respect to the rocker.

20. The person support apparatus of claim 19, wherein the tilt mechanism includes a force sensor.

21. The person support apparatus of claim 19, wherein the tilt mechanism includes a dampener configured to adjust the rate of rotation of the upper frame with respect to the lower frame.

* * * * *